US008858693B2

(12) United States Patent
Penik, Jr.

(10) Patent No.: US 8,858,693 B2
(45) Date of Patent: Oct. 14, 2014

(54) ELECTROLESS PLATING BATH COMPOSITION AND METHOD OF PLATING PARTICULATE MATTER

(75) Inventor: Stephen E. Penik, Jr., Colonia, NJ (US)

(73) Assignee: OMG Electronic Chemicals, LLC, South Plains, NJ (US)

( * ) Notice: Subject to any disclaimer, the term of this patent is extended or adjusted under 35 U.S.C. 154(b) by 130 days.

(21) Appl. No.: 13/348,145

(22) Filed: Jan. 11, 2012

(65) Prior Publication Data

US 2012/0177925 A1 Jul. 12, 2012

Related U.S. Application Data

(60) Provisional application No. 61/431,675, filed on Jan. 11, 2011.

(51) Int. Cl.

| | |
|---|---|
| ***C23C 18/34*** | (2006.01) |
| ***C23C 18/36*** | (2006.01) |
| ***B05D 7/24*** | (2006.01) |
| ***B32B 5/16*** | (2006.01) |
| ***C23C 18/16*** | (2006.01) |

(52) U.S. Cl.
CPC ..... *C23C 18/34* (2013.01); *C23C 18/1662* (2013.01)
USPC ..... 106/1.22; 106/1.27; 427/217; 428/403

(58) Field of Classification Search
CPC ..... C23C 18/1662; C23C 18/34
USPC ..... 106/1.22, 1.27; 427/217; 428/403
See application file for complete search history.

(56) References Cited

U.S. PATENT DOCUMENTS

| | | | | | |
|---|---|---|---|---|---|
| 3,485,597 | A | * | 12/1969 | Pearlstein | 428/649 |
| 3,556,839 | A | | 1/1971 | Roy | |
| 3,753,742 | A | * | 8/1973 | Bell et al. | 106/1.22 |
| 3,924,031 | A | * | 12/1975 | Nicholas et al. | 427/217 |
| 4,061,802 | A | * | 12/1977 | Costello | 106/1.27 |
| 4,063,907 | A | * | 12/1977 | Lee et al. | 427/217 |
| 4,435,189 | A | * | 3/1984 | Bovenkerk | 427/217 |
| 5,024,680 | A | * | 6/1991 | Chen et al. | 51/295 |
| RE33,767 | E | | 12/1991 | Christini et al. | |
| 5,112,392 | A | * | 5/1992 | Anderson et al. | 106/1.22 |
| 5,190,796 | A | * | 3/1993 | Iacovangelo | 427/304 |
| 5,232,469 | A | | 8/1993 | McEachron et al. | |

(Continued)

FOREIGN PATENT DOCUMENTS

| | | |
|---|---|---|
| JP | 53/144835 | * 12/1978 |
| JP | 53/144836 | * 12/1978 |
| JP | 53/144837 | * 12/1978 |
| JP | 03/010086 | * 1/1991 |

OTHER PUBLICATIONS

The International Bureau of WIPO, International Preliminary Report on Patentability and Written Opinion, Date of Mailing—Jul. 25, 2013, Geneva, Switzerland.

*Primary Examiner* — Helene Klemanski
(74) *Attorney, Agent, or Firm* — Hanh Loeser & Parks LLP

(57) ABSTRACT

An electroless plating bath composition for plating particulate matter is provided. The plating bath composition includes a metal-containing component and a reducing component. The particulate matter is plated with at least one metal layer including at least two metals by electroless metal deposition in order to provide cutting and grinding tools with improved wear resistance.

33 Claims, 1 Drawing Sheet

(56) References Cited

U.S. PATENT DOCUMENTS

| | | | | |
|---|---|---|---|---|
| 5,232,744 | A | 8/1993 | Nakamura et al. | |
| 5,250,086 | A | 10/1993 | McEachron et al. | |
| 5,269,838 | A | 12/1993 | Inoue et al. | |
| 5,306,318 | A * | 4/1994 | Carius et al. | 51/293 |
| 5,607,489 | A * | 3/1997 | Li | 51/309 |
| 5,759,216 | A * | 6/1998 | Kanada et al. | 51/309 |
| 6,048,585 | A * | 4/2000 | Martyak et al. | 106/1.22 |
| 6,586,047 | B2 | 7/2003 | Durkin et al. | |
| 2003/0099849 | A1 | 5/2003 | Wu et al. | |
| 2003/0232148 | A1 * | 12/2003 | Shahin | 106/1.22 |
| 2005/0129975 | A1 * | 6/2005 | Ihara | 428/678 |

* cited by examiner

ELECTROLESS PLATING BATH COMPOSITION AND METHOD OF PLATING PARTICULATE MATTER

CROSS-REFERENCE TO RELATED APPLICATIONS

This patent application claims the benefit of U.S. Provisional Patent Application No. 61/431,675, filed Jan. 11, 2011, the disclosure of which is expressly incorporated by reference herein.

TECHNICAL FIELD

The invention relates to an electroless plating bath composition. More particularly, the invention relates to an electroless nickel plating bath composition and plating a metal layer including at least two metals onto the particulate matter with such a composition.

BACKGROUND OF THE INVENTION

The electroless coating of objects is well known. It is also well known in the art that the plating of metal layers can improve the retention of diamond particles in the matrices of cutting tools, such as those used to saw stone and concrete, and grinding tools, such as metal bond wheels. Metal plated particulate material, including natural or synthetic diamonds, are commercially available with nickel coatings typically applied by electroless deposition. While such coated particulate materials provide good performance, improvements are desired to reduce the premature loss of particles and reduce the wear of cutting tools.

While it is known that plating metal layers applied by electroless deposition chemically bind to the surface of particulate matter, other metals which adhere to and form metal layers on the particulate surfaces more strongly include molybdenum, titanium and chromium. These metals are carbide formers and are typically chemically vapor-deposited or sputtered onto particulate surfaces.

These carbide forming metal layers have been used as part of multi-layer coatings on diamond particles to aid retention within a tool matrix. This alloy layer may be over coated with another layer such as nickel by electroless or electrolytic deposition. The alloys comprise at most 30 wt % of the carbide forming metal and, to form the carbide, the coating is heated at high temperatures after deposition by vacuum evaporation or sputtering. These procedures for applying multi-layer coatings are complex in that either metal alloys are applied as one of the layers, or three distinct layers are used. In addition, these procedures provide increased bonding strength between the diamond particles and the tool matrix through carburization of the metal coating, during which the diamond particles are exposed to high temperatures. High temperatures can cause degradation of the diamond crystal, which is detrimental to the performance of the cutting tool.

Notwithstanding the state of the art as described herein, there is a need for an electroless plating bath composition that plates at least one metal layer onto particulate matter by a simpler method which will aid its retention within the matrix of a cutting and grinding tools and improve the tool wear resistance.

SUMMARY OF THE INVENTION

In general, one aspect of the invention is to provide an electroless nickel plating bath composition for plating the surface of particulate matter. The plating bath includes a metal-containing component, wherein the metal-containing component includes a nickel salt, at least one metal salt selected from the group consisting of a calcium salt, a magnesium salt, a strontium salt, and a barium salt, a chelating agent, and water. The plating bath also includes a reducing component, wherein the reducing component includes a reducing agent, and water.

Another aspect of the invention is to provide a method of electrolessly plating particulate matter. The method includes the steps of charging a vessel with particulate matter, and then charging the vessel containing the particulate matter with solutions including an electroless plating bath composition and an activating component. The plating bath composition includes a metal-containing component, wherein the metal-containing component comprises, a nickel salt, at least one metal salt selected from the group consisting of a calcium salt, a magnesium salt, a strontium salt, and a barium salt a chelating agent, and water, and a reducing component, wherein the reducing component comprises a reducing agent, and water. The method also includes mixing the plating bath composition, activating component, and particulate matter at a temperature between about 60° C. and about 100° C. at a pH between about 4 and about 13 and plating at least one metal layer onto the particulate matter, wherein the metal layer includes at least two metals.

Still yet another aspect of the invention is to provide a coated article formed by electroless plating of particulate matter. The coated article comprises particulate matter having a defined outer surface area, wherein the particulate matter is selected from the group consisting of natural diamonds and synthetic diamonds having at least one metal layer, wherein the at least one metal layer is plated onto the outer surface of the particulate matter and includes nickel and at least one additional metal selected from the group consisting of calcium, magnesium, strontium, and barium.

A further aspect of the invention is to provide metal plated particulate matter with improved wear performance for cutting and grinding tools that includes a metal layer of nickel and at least one additional metal selected from the group consisting of calcium, magnesium, strontium, and barium.

Another aspect of the invention is to provide cutting and grinding tools with improved wear resistance which includes metal plated particulate matter having at least one metal layer of nickel and at least one additional metal selected from the group consisting of calcium, magnesium, strontium, and barium.

DETAILED DESCRIPTION OF THE INVENTION

Figure 1:
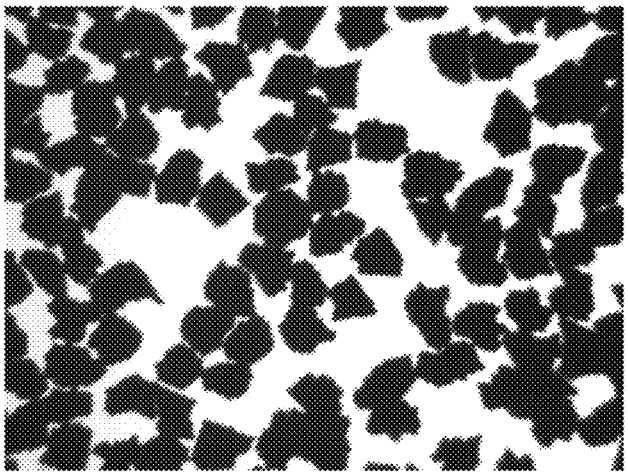
FIG. 1 is a scanning electron microscope image of plated particulate matter according to one embodiment of the invention.

In one embodiment of the invention, particulate matter is plated with at least one metal layer, which includes nickel and at least one additional metal selected from the group consisting of calcium, magnesium, strontium, and barium, deposited by electroless metal deposition in order to provide cutting and grinding tools with improved wear resistance. Preferably, multiple layers, including up to 20 layers or more, can be plated onto the particulate matter.

The at least one metal layer plated onto the particulate matter is provided by an electroless plating bath composition and results in a coated article. The plating bath includes a metal-containing component and a reducing component.

The metal-containing component includes a nickel salt, at least one additional metal salt, wherein the metal of the metal salt is selected from the group consisting of calcium, magnesium, strontium, and barium, a chelating agent, and water. The amount of water generally comprises about 60.0-80.0%, or alternatively about 50.0-70.0%, by weight of the metal-containing component. In one embodiment, the nickel salt is selected from the group consisting of nickel sulfate, nickel chloride, and nickel acetate. The nickel salt generally comprises about 6.0-12.0% by weight, or alternatively about 8.0-10.0% by weight of the metal-containing component. In another embodiment, the at least one additional metal salt is selected from the group consisting of calcium sulfate, calcium chloride, calcium acetate, magnesium sulfate, magnesium chloride, magnesium acetate, strontium sulfate, strontium chloride, strontium acetate, barium sulfate, barium chloride, and barium acetate. Preferably, the at least one metal salt includes calcium chloride, magnesium chloride, and combinations thereof. The at least one additional metal salt generally comprises about 3.0-18.0% by weight, or alternatively about 10.0-14.0% by weight of the metal-containing component. In yet another embodiment, the chelating agent is acetic acid and generally comprises about 5.0-11.0% by weight, or alternatively about 7.0-9.0% by weight of the metal-containing compound. The metal-containing component may also include a caustic metallic base, including caustic soda, wherein the base balances the pH of the composition which has a tendency to become acidic during the electroless plating process. The caustic metallic base generally comprises about 2.0-8.0% by weight, or alternatively about 4.0-6.0% by weight of the metal-containing component.

The reducing component includes a reducing agent and water. The amount of water generally comprises about 50.0-70.0% by weight, or alternatively about 55.0-60.0% by weight of the reducing component. In one embodiment, the reducing agent is selected from the group consisting of sodium hypophosphite, sodium borohydride, and hydrogen. The reducing agent generally comprises about 30.0-50.0% by weight, or alternatively about 35.0-45.0% by weight of the reducing component. The reducing component may also include a metal acetate, for example sodium acetate, which buffers the pH of the plating bath composition. The metal acetate generally comprises about 0.01-0.2% by weight, or alternatively about 0.05-0.1% by weight of the reducing component.

The particulate matter utilized in this invention may include diamond abrasive particles. These particles are of the size conventionally used in cutting tools such as, for example, those of 20/80 U.S. mesh size. The size of the particles can vary widely within the range of about 1/1500 μm, to about 150-1000 μm, and even about 200-600 μm. Conventionally sized diamond abrasive particles are sufficiently large so as to provide a cutting profile for the tools desired and not be excessively diluted by the metal coatings to be applied.

The diamond abrasive particles used in this invention can be natural or synthetic but are typically obtained by conversion of graphite under high pressure and high temperature (HP/HT), either with or without a catalyst. Preferably, the diamonds are of a size within the range of from about 20 to about 80 U.S. mesh and are obtained directly from a conversion process. However, the diamond particles utilized can be obtained from larger sized materials which are milled or pulverized by conventional techniques.

The coated diamond abrasive particles may be impregnated within a suitable metal matrix by conventional techniques when used in cutting and grinding tools. For example, a mixture of the coated particles and metal particles can be pressed at ambient temperature to the shape desired and the pressed article heated so as to sinter the metal therein. Suitable metals include nickel, cobalt, etc. For example, tool inserts for saw blades may include 30-40 mesh size diamond particles coated with chromium and nickel and bound by a sintered nickel, cobalt, and/or cobalt/bronze matrix. These tool inserts can be of any form or shape, particularly those shapes which are conventional for tools used to cut stone and concrete.

The following Examples illustrate the components, as well as amounts, of the electroless plating bath composition and a method of plating particulate matter with the electroless plating bath composition. These Examples are to be construed as merely illustrative, and not limitative of the remainder of the disclosure in any way whatsoever.

EXAMPLES

Example 1

Electroless Plating Bath Composition

| Metal-Containing Component (weight percent) | |
|---|---|
| 60.0-80.0% | deionized water |
| 6.0-12.0% | nickel sulfate |
| 3.0-9.0% | calcium chloride |
| 5.0-11.0% | acetic acid |
| 2.0-8.0% | caustic soda |
| Reducing Component (weight percent) | |
| 50.0-70.0% | deionized water |
| 30.0-50.0% | sodium hypophosphite |
| 0.01-0.2% | sodium acetate |

Example 2

Electroless Plating Bath Composition

| Metal-Containing Component (weight percent) | |
|---|---|
| 70.0-75.0% | deionized water |
| 8.0-10.0% | nickel sulfate |
| 5.0-7.0% | calcium chloride |
| 7.0-9.0% | acetic acid |
| 4.0-6.0% | caustic soda |
| Reducing Component (weight percent) | |
| 55.0-65.0% | deionized water |
| 35.0-45.0% | sodium hypophosphite |
| 0.05-0.1% | sodium acetate |

Example 3

Electroless Plating Bath Composition

| Metal-Containing Component (weight percent) | |
|---|---|
| 60.0-80.0% | deionized water |
| 6.0-12.0% | nickel sulfate |

-continued

| | |
|---|---|
| 3.0-9.0% | magnesium chloride |
| 5.0-11.0% | acetic acid |
| 2.0-8.0% | caustic soda |
| Reducing Component (weight percent) | |
| 50.0-70.0% | deionized water |
| 30.0-50.0% | sodium hypophosphite |
| 0.01-0.2% | sodium acetate |

Example 4

Electroless Plating Bath Composition

| Metal-Containing Component (weight percent) | |
|---|---|
| 70.0-75.0% | deionized water |
| 8.0-10.0% | nickel sulfate |
| 5.0-7.0% | magnesium chloride |
| 7.0-9.0% | acetic acid |
| 4.0-6.0% | caustic soda |
| Reducing Component (weight percent) | |
| 55.0-65.0% | deionized water |
| 35.0-45.0% | sodium hypophosphite |
| 0.05-0.1% | sodium acetate |

Example 5

Electroless Plating Bath Composition

| Metal-Containing Component (weight percent) | |
|---|---|
| 60.0-80.0% | deionized water |
| 6.0-12.0% | nickel sulfate |
| 3.0-9.0% | calcium chloride |
| 3.0-9.0% | magnesium chloride |
| 5.0-11.0% | acetic acid |
| 2.0-8.0% | caustic soda |
| Reducing Component (weight percent) | |
| 50.0-70.0% | deionized water |
| 30.0-50.0% | sodium hypophosphite |
| 0.01-0.2% | sodium acetate |

Example 6

Electroless Plating Bath Composition

| Metal-Containing Component (weight percent) | |
|---|---|
| 70.0-75.0% | deionized water |
| 8.0-10.0% | nickel sulfate |
| 5.0-7.0% | calcium chloride |
| 5.0-7.0% | magnesium chloride |
| 7.0-9.0% | acetic acid |
| 4.0-6.0% | caustic soda |
| Reducing Component (weight percent) | |
| 55.0-65.0% | deionized water |
| 35.0-45.0% | sodium hypophosphite |
| 0.05-0.1% | sodium acetate |

Example 7

Electroless Plating of Particulate Matter

During the first cycle of electroless plating, a suitable vessel for carrying out the electroless plating of the particulate matter is charged with a predetermined amount of particulate matter and then filled with warm deionized water for prerinsing. The vessel containing the particulate matter and water is heated to a temperature between about 60° C. and about 100° C., preferably about 70° C., followed by the decanting of the water from the vessel. The metal-containing component of Example 1 is then charged into the vessel followed by the addition of an activating component and then the reducing component. In one embodiment, the activating component includes a solution of a palladium salt, for example palladium chloride, in hydrochloric acid that activates the nonconductive surface of the particulate matter. The concentration of the activating component can range from about 2.0-10.0 grams of palladium salt per liter of hydrochloric acid. In one embodiment, the palladium salt is palladium chloride. In alternate embodiments, the metal-containing component and reducing component of Example 1 may be substituted with the metal-containing component and reducing component of Examples 2-6.

The solution, which includes the metal-containing component, the reducing component, and the activating component, is then stirred for a time period of 10-30 minutes resulting in a metal layer beings electrolessly plated onto the surface of the particulate matter. After plating of the metal layer during the first cycle, the resulting solution is removed from the vessel and the plated particulate matter may then be washed with deionized water which is subsequently removed from the vessel. The resulting metal layer includes nickel and at least one additional metal selected from the group consisting of calcium, magnesium, strontium, and barium. In one embodiment, the metal layer includes nickel and calcium. In another embodiment, the metal layer includes nickel and magnesium. In yet another embodiment, the metal layer includes nickel, calcium, and magnesium.

During plating of the at least one metal layer on the particulate matter, the pH of the solution may be maintained between 4 and 13, but is preferably maintained between 6 and 9. Also, during plating of the metal layer on the particulate matter, the temperature of the reaction mixture during mixing may be maintained between about 60° C. and about 100° C., preferably about 70° C.

After completing the first cycle of depositing a first metal layer onto the particulate matter as described herein, additional cycles may be performed in order to plate additional metal layers onto the particulate matter. In one embodiment, the particulate matter may be subjected to about 20 cycles resulting in 20 metal layers plated onto the particulate matter.

Figure 2:
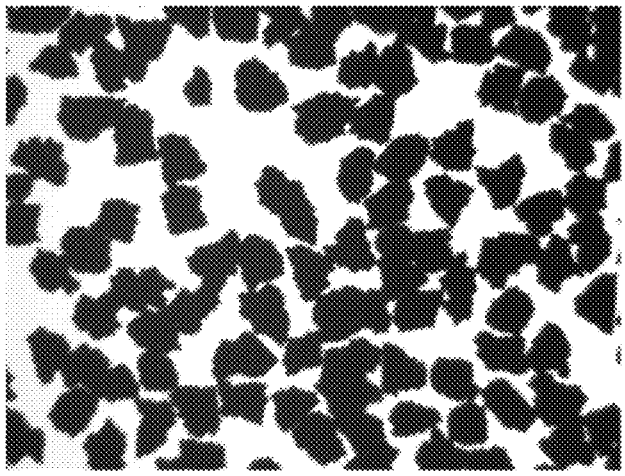
FIG. 2 is a scanning electron microscope image of plated particulate matter according to another embodiment of the invention.

The plating of the particulate matter, based upon the electroless plating method described herein, provides plated particulate matter as shown in the scanning electron microscope images of FIGS. 1 and 2. As seen in each of these figures, the surface profile of the plated particulate matter is modified. Though not wishing to be bound by theory and with reference to FIGS. 1 and 2, it is believed that the modification of the surface profile of the plated particulate matter provides additional surface area to the particulate matter. It is believed that this increased surface area may improve retention of the plated particulate matter when deposited onto the surface of suitable cutting and grinding tools. This in turn is results in enhanced wear performance of the cutting and grinding tools.

Based upon the foregoing disclosure, it should now be apparent that the electroless plating bath composition and method of plating particulate matter with such a composition as described herein will carry out the objects set forth hereinabove. It is, therefore, to be understood that any variations evident fall within the scope of the claimed invention and thus, the selection of specific component elements can be determined without departing from the spirit of the invention herein disclosed and described.

What is claimed is:

1. An electroless plating bath composition for plating particulate matter, the plating bath composition comprising:

a metal-containing component, wherein the metal-containing component includes:

a nickel salt;

at least one metal salt comprising calcium chloride;

a chelating agent; and water; and a reducing component, wherein the reducing component includes:

a reducing agent; and water.

2. The plating bath composition of claim 1, wherein the nickel salt is selected from the group consisting of nickel sulfate, nickel chloride, and nickel acetate.

3. The plating bath composition of claim 1, which further comprises at least one additional metal salt selected from the group consisting of calcium sulfate, calcium acetate, magnesium sulfate, magnesium chloride, magnesium acetate, strontium sulfate, strontium chloride, strontium acetate, barium sulfate, barium chloride, and barium acetate.

4. The plating bath composition of claim 3, wherein the at least one metal salt further comprises magnesium chloride.

5. The plating bath composition of claim 1, wherein the at least one metal salt of the metal-containing component further includes a second metal salt selected from the group consisting of a magnesium salt, a strontium salt, and a barium salt.

6. The plating bath composition of claim 5, wherein the at least one metal salt of the metal containing component is two metal salts which are selected from the group consisting of the calcium salt and the magnesium salt.

7. The plating bath composition of claim 6, wherein the calcium salt is calcium chloride and the magnesium salt is magnesium chloride.

8. The plating bath composition of claim 6, wherein the particulate matter is selected from the group consisting of natural diamonds and synthetic diamonds.

9. The plating bath composition of claim 1, wherein the chelating agent is acetic acid.

10. The plating bath composition of claim 1, wherein the reducing agent is selected from the group consisting of sodium hypophosphite, sodium borohydride, and hydrogen gas.

11. The plating bath composition of claim 1, wherein the metal-containing component further comprises a caustic metallic base and the reducing component further comprises a metal acetate, wherein the caustic metallic base and metal acetate buffers the pH of the plating bath composition.

12. A method of electrolessly plating particulate matter, the method comprising the steps of:

charging a vessel with particulate matter;

charging the vessel containing the particulate matter with solutions including an electroless plating bath composition and an activating component, wherein the plating bath composition includes:

a metal-containing component, wherein the metal-containing component comprises:

a nickel salt;

at least one metal salt selected from the group consisting of a calcium salt, a magnesium salt, a strontium salt, and a barium salt a chelating agent; and water; and a reducing component, wherein the reducing component comprises:

a reducing agent; and water;

mixing the plating bath composition, activating component, and particulate matter at a temperature between about 60° C. and about 100° C. at a pH between about 4 and about 13; and plating at least one metal layer onto the particulate matter, wherein the metal layer includes at least two metals.

13. The method of claim 12, wherein the at least one metal layer includes nickel and at least one additional metal selected from the group consisting of calcium, magnesium, strontium, and barium.

14. The method of claim 12, wherein the nickel salt is selected from the group consisting of nickel sulfate, nickel chloride, and nickel acetate.

15. The method of claim 12, wherein the at least one metal salt is selected from the group consisting of calcium sulfate, calcium chloride, calcium acetate, magnesium sulfate, magnesium chloride, magnesium acetate, strontium sulfate, strontium chloride, strontium acetate, barium sulfate, barium chloride, and barium acetate.

16. The method of claim 15, wherein the at least one metal salt is calcium chloride.

17. The method of claim 15, wherein the at least one metal salt is magnesium chloride.

18. The method of claim 12, wherein the metal-containing component includes at least two metal salts selected from the group consisting of a calcium salt, a magnesium salt, a strontium salt, and a barium salt.

19. The method of claim 12, wherein the particulate matter is selected from the group consisting of natural diamonds and synthetic diamonds.

20. The method of claim 12, wherein the activating component is a solution of a palladium salt and hydrochloric acid.

21. The method of claim 20, wherein the palladium salt is palladium chloride.

22. The method of claim 12, wherein the vessel containing the particulate matter is first charged with the metal-containing component, followed by the activating component, and then the reducing component.

23. A coated article formed by electroless plating of particulate matter, the coated article comprising:

particulate matter having a defined outer surface area, wherein the particulate matter is selected from the group consisting of natural diamonds and synthetic diamonds having at least one metal layer, wherein the at least one metal layer is plated onto the outer surface of the particulate matter and includes nickel and at least one additional metal selected from the group consisting of calcium, magnesium, strontium, and barium.

24. An electroless plating bath composition for plating particulate matter, the plating bath composition comprising:

a metal-containing component, wherein the metal-containing component includes:

a nickel salt;

at least one first metal salt comprising magnesium chloride and at least one second metal salt selected from the group consisting of a calcium salt, a strontium salt and a barium salt;

a chelating agent; and water; and a reducing component, wherein the reducing component includes:

a reducing agent; and water.

25. The plating bath composition of claim 24, wherein the nickel salt is selected from the group consisting of nickel sulfate, nickel chloride, and nickel acetate.

26. The plating bath composition of claim 24, wherein the at least one second metal salt is selected from the group consisting of calcium sulfate, calcium chloride, calcium acetate, strontium sulfate, strontium chloride, strontium acetate, barium sulfate, barium chloride, and barium acetate; and the at least one first metal salt further comprises at least one of magnesium sulfate and magnesium acetate.

27. The plating bath composition of claim 26, wherein the at least one second metal salt is calcium chloride.

28. The plating bath composition of claim 24, wherein the at least one second metal salt is the calcium salt.

29. The plating bath composition of claim 28, wherein the at least one second metal salt is calcium chloride.

30. The plating bath composition of claim 28, wherein the particulate matter is selected from the group consisting of natural diamonds and synthetic diamonds.

31. The plating bath composition of claim 24, wherein the chelating agent is acetic acid.

32. The plating bath composition of claim 24, wherein the reducing agent is selected from the group consisting of sodium hypophosphite, sodium borohydride, and hydrogen gas.

33. The plating bath composition of claim 24, wherein the metal-containing component further comprises a caustic metallic base and the reducing component further comprises a metal acetate, wherein the caustic metallic base and metal acetate buffers the pH of the plating bath composition.

* * * * *